United States Patent [19]

Arentzen

[11] 4,148,630

[45] Apr. 10, 1979

[54] DIRECT PRODUCTION OF COPPER METAL

[75] Inventor: Charles Arentzen, Tucson, Ariz.

[73] Assignee: The Anaconda Company, Denver, Colo.

[21] Appl. No.: 827,359

[22] Filed: Aug. 24, 1977

[51] Int. Cl.[2] ..... C22B 15/00

[52] U.S. Cl. ..... 75/74

[58] Field of Search ..... 75/72–76, 75/92

[56] References Cited

U.S. PATENT DOCUMENTS

| | | | |
|---|---|---|---|
| 2,668,107 | 2/1954 | Gordon et al. | 75/74 |
| 3,701,648 | 10/1972 | Ashby et al. | 75/72 |
| 3,796,568 | 3/1974 | Szekely et al. | 75/72 |

*Primary Examiner*—M. J. Andrews

*Attorney, Agent, or Firm*—Pennie & Edmonds

[57] ABSTRACT

This invention comprises a process for the direct production of copper metal from a cupriferous slurry comprising forming a molten bath of cupriferous material at a temperature of about 2100° to 2400° F., at least one of said bath and said slurry comprising sufficient sulfidic material to develop and maintain said bath temperature by oxidation of said sulfidic material, injecting an oxygen-containing gas and said cupriferous slurry into said molten bath, said injection being accomplished by use of a high-velocity stream of said gas and slurry directed at the surface of said bath at an angle of from about 20° to 40° from the horizontal, and separately withdrawing the resulting slag and metallic copper from the bath, the proportion of slurry and volume of oxygen injected being adjusted with respect to the available sulfidic material to permit operation at a temperature range of from about 2100° to 2400° F.

9 Claims, 2 Drawing Figures

DIRECT PRODUCTION OF COPPER METAL

BACKGROUND OF THE INVENTION

The present invention is directed to a process for forming molten metallic copper of blister quality from cupriferous material. The blister copper is readily transformed into anode copper.

Cupriferous materials are formed by various steps in the production of copper. These copper metallurgical materials include copper precipitates produced by cementation processes as well as collected flue dust and secondary material and copper sulfide concentrates, including sulfide ore and the solid residue from acidic leaching of copper ore materials. These copper materials require further processing to produce metallic copper. Various processes have been conventionally used which entail a multiplicity of steps, do not directly form metallic copper, and/or require elaborate refining procedures and equipment to produce the desired metallic material. For example, U.S. Pat. No. 3,102,806 to Zimmerley and U.S. Pat. No. 2,668,107 to Gordon et al disclose the smelting of the copper metallurgical material to produce copper matte and slag materials. These processes do not produce the more desired metallic copper. Further, U.S. Pat. No. 3,326,671 to Worner teaches the direct continuous production of metallic copper by the utilization of a special compartmentalized furnace. Worner's process further requires special atmospheric controls and regulation of the molten bath circulation to produce the desired product.

The recovery of metallic copper from a cupriferous material by a method which is direct and which substantially utilizes conventional equipment is, therefore, highly desired.

SUMMARY OF THE INVENTION

The present invention is directed to a new process for the direct production of metallic copper from a cupriferous slurry which is economical, efficient, and which utilizes conventional equipment.

Briefly, the invention comprises a process for the direct production of copper metal from a cupriferous slurry comprising forming a molten cupriferous bath at a temperature of from about 2100° to 2400° F., at least one of said bath and said slurry comprising sufficient sulfidic material to develop and maintain said bath temperature by oxidation of said sulfidic material, injecting an oxygen-containing gas and a slurry of the cupriferous material into said molten bath, said injection being accomplished by use of a high-velocity stream of said gas and slurry directed at the surface of said bath at an angle of approximately 30°; i.e., about 20° to 40° from the horizontal, and separating the slag from the metallic copper, the proportion of slurry and volume of oxygen injected being adjusted with respect to the available sulfidic material to permit operation at a temperature range of from about 2100° to 2400° F.

DETAILED DESCRIPTION OF THE INVENTION

Figure 1:
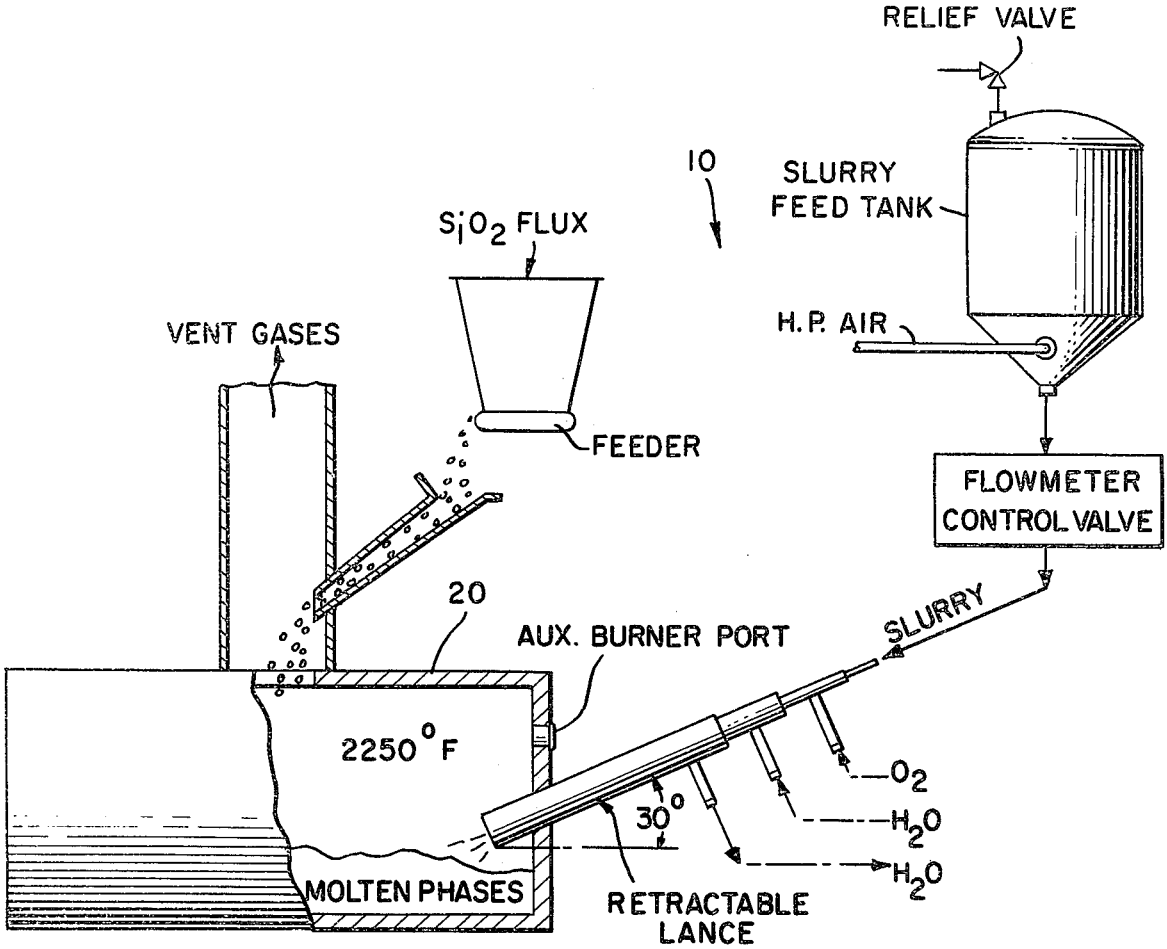
FIG. 1 is a schematic view, partly in section, of an apparatus system suitable for carrying out the instant process.

This invention will be described in connection with the drawings showing an apparatus system suitable for carrying out the invention. The cupriferous materials which may be treated by the present invention include copper matte which is normally a metallic sulfide product produced in the smelting of sulfide ores in reverberatory furnaces and the like, copper sulfide concentrates, ore material remaining after an acidic leach of mixed copper oxide-sulfide ores and the like, and cement copper precipitates. These materials are first formed into a slurry by being admixed with water. For processing convenience the slurry can be maintained in a slurry feed tank from which it is conducted to a smelting furnace 20. A flowmeter control valve can be suitably used to control the amount of slurry being fed to the furnace for continuous autogenous operation as hereinafter described.

The furnace 20 can be any conventional reverberatory smelting furnace used in the smelting of copper materials or even a converter, such as a Peirce-Smith converter.

It is required for successful operation that the bath and/or slurry contain sufficient sulfidic material to fuel the reaction to the temperature necessary to maintain the reaction. The oxidation of the sulfide is what generates the necessary heat and those skilled in this art can readily calculate the amounts of sulfide material required to attain the necessary reaction temperature as hereinafter described.

There are two modes of operation employed, both dependent upon the attaining the thermal balance necessary for successful operation. When the heat balance is favorable for autogenous operation, the process is conducted continuously with continuous injection of cupriferous slurry and continuous production of metallic copper and slag. When the heat balance is unfavorable for autogenous operation, as when using cement copper, an initial charge of molten matte, which contains copper sulfide, can be used to make up the heat deficiency and a batch-type operation using batch injection of slurry with batch production of metallic copper and slag will now proceed successfully. In general, a slurry of sulfide concentrates will be autogenous and a slurry of cement copper precipitates containing insufficient sulfides will not be autogenous and requires a charge of molten matte to attain operating thermal conditions.

With the batch type operation, the initial bath can be formed from copper matte or a mixture of copper matte and slag. For example, molten slag from refining furnaces or molten slag from the last completed batch cycle can be recycled to the start of a new cycle and join the new charge of molten matte.

The process of the present invention requires the introduction of an aqueous slurry of sulfide concentrates or mixtures of such with cement copper precipitates into a molten bath of the cupriferous material. The slurry is formed by mixing the solids with water to about 25% water based on total weight of the mixed slurry. The slurry is then screened on a 4 or 8 mesh screen to remove coarser sizes. A larger meshed screen may be utilized so long as the coarser size materials are not of a size to plug the slurry delivery system used.

Concurrently with the introduction of the slurry to the molten bath, it is required to inject an oxygen-containing gas into the molten bath in the smelting furnace.

Figure 2:
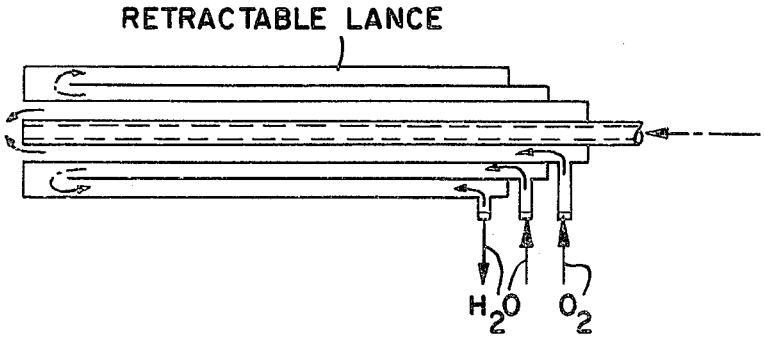
FIG. 2 is an enlarged sectional view of the retractable lance depicted in FIG. 1.

The oxygen-containing gas is injected concurrently with the copper slurry either via separate lances which project through the side wall of the furnace, or by the utilization of a single lance as shown in FIGS. 1 and 2 having at least one pair of concentrically arranged feeder tubes. Each tube separately carries the oxygen-containing gas and the slurry, respectively. The oxygen-containing gas should contain a high concentration of oxygen therein, and it is preferred, therefore, that it be substantially pure oxygen, such as commercially pure oxygen. By utilizing substantially pure oxygen feed, one more readily obtains the necessary thermal conditions.

Alternately, the slurry feed may be formed by initially forming an aqueous slurry of the sulfide concentrate and a separate slurry of the cement copper precipitate. The mixing of these slurries is monitored in a manner so as to permit the adjusting of the concentration of the sulfide to cement copper precipitate within the slurry mixture as it is introduced into the smelting furnace. By adjusting the sulfide to cement copper precipitate in the feed slurry, one is able to maintain operation at a temperature of about 2100° to 2400° F., with about 2200° to 2300° F. being most preferred. When the temperature falls below the desired temperature range, the amount of sulfide concentrate can be increased, and when the temperature approaches the upper desired temperature, the amount of precipitate can be increased. For autogeneous operations it is necessary that the heat of reaction maintain the temperature at from about 2100° to 2400° F.

The weight ratio of sulfide concentrate to cement copper should be maintained at from about 3 to 0.3 in the feed if a mixed slurry is used. A ratio of about 1:1 has been found satisfactory for most operations.

The slurry may, in addition, contain other materials which are normally present during smelting operations. Such materials include silica, siliceous flux, lime and the like. In the alternative, such additives may be introduced separately into the molten bath of the smelter furnace by means of separate feeders as is shown in FIG. 1.

The injection of the slurry and gas must be accomplished at a high velocity to ensure prompt and intimate admixture of the slurry and gas with the molten material. This is best accomplished by the lance or lances. These are used to introduce the slurry and oxygen gas into the smelter furnace and are preferably retractable and project at an angle to the horizontal through the side walls of the furnace. The angle is normally between 20° and 40°, and most suitably 30°, with respect to the horizontal and, as such, causes the combined flow of oxygen gas and slurry material to impinge upon and into the surface of the molten material in a manner which causes substantial mixing of the slurry with the molten material. The particular velocity necessary will vary dependent upon the material used, but can be readily determined by making trial runs to ascertain optimum conditions. Water can be circulated through the lance, or lances, to minimize heat damage due to the smelter temperatures.

The smelter furnace may contain tapholes (not shown) at various locations to permit the withdrawal of both the molten metallic copper and the slag material from the smelting furnace. Molten copper of blister quality is thus formed within the smelter furnace and can be readily fire-refined and cast into anodes for processing by electrolytic methods to form cathode copper of high quality. A portion of the slag material can be recycled for use as slag blow in a subsequent cycle or treated by other conventional processes within the smelter plant. Gaseous products formed within the smelter furnace are predominantly sulfur dioxide and water vapors. These gaseous products (vent gases) may be handled separately or may be combined with the gas streams of conventional smelters and converted to sulfuric acid in accordance with conventional practice.

As noted, the process of the present invention may be used in a batch or continuous operation, dependent upon the heat balance generated by the feed. Such heat balance can be readily calculated by those skilled in this art once the particular slurry feed is known. Autogenous conditions are maintained at the smelting temperatures of about 2100° to 2400° F. by regulating the amount of slurry and flow rate of oxygen in the case of continuous operation. By balancing the ratio of cement copper precipitate to sulfide concentrate in the slurry, and the amount of such slurry and oxygen flow rate to the smelter, the amount of matte copper intially added can be predetermined in the case of batch operation. In both cases, the metallic copper and slag material are removed either on a continuous basis or at intervals which permits a workable volume of molten material to remain within the smelter furnace.

At the end of each batch smelting operation, the oxygen-slurry feed is stopped, the slag is again removed, and the blister copper is separately removed. The blister copper is transferred for further processing to form the desired copper product. The final slag material formed within the smelting furnace may be returned thereto and utilized as a part of the initial feed along with additional matte material to form a molten bath of copper metallurgical material. The oxygen-slurry injection is again commenced for the initiation for the next cyclic procedure.

It must be emphasized that it is critical in the instant process to inject the slurry with a high pressure oxygen-containing gas stream into the molten bath at an angle of approximately 30° from the horizontal. A non-submerged lance is preferred as the means for directing such stream.

The invention will be further described in connection with the following examples which are set forth for purposes of illustration only and are not to be construed as limiting the scope of the invention in any manner. All parts and percentages are by weight unless otherwise stipulated.

EXAMPLE 1

100 parts copper precipitate having a copper content of 80 percent as obtained from a cementation launder were mixed with 100 parts copper sulfide concentrate having a copper content of 28 percent. To this mixture was added 15.5 parts $SiO_2$ and 3.5 parts limestone which were previously ground to a particle size of 48 mesh (Tyler) or less. 73 parts of water were added to the solids and the total mixture was passed through a vibrating screen of 10 mesh (Tyler) to form a uniform slurry having a density of approximately 150 lbs/ft$^3$.

61.4 parts of matte material having 52 percent copper therein were charged to a Peirce-Smith converter at 2050° F. A water-cooled lance having a pair of concentrically arranged feed tubes projected through the end wall of the converter at about 30° with respect to the horizontal. The feed end of the lance was directly above the surface of the molten bath. Through the lance, 13 parts of oxygen and 38.4 parts of the preformed slurry were impinged onto the surface of the molten bath over a period of about 100 minutes. An additional 4.5 parts solid $SiO_2$ were directly added to the molten bath in small quantities during the same period. The oxygen-slurry feed was stopped and 50 parts of slag were removed from the top of the molten bath to leave within the smelter furnace approximately 64 parts of white metal. The oxygen-slurry feed was again commenced. 21.2 parts of oxygen and 44.9 parts of slurry were impinged onto the molten bath over a period of 167 minutes. The temperature of the furnace was maintained at 2250° F. throughout the process. The oxygen-slurry feed was again terminated and 15 parts of slag were removed and 74.6 parts of blister copper were recovered. The slag was recycled to form part of the initial copper metallurgical material used to form the molten bath of the next cycle. The flue gases of the furnace contained a substantial proportion of sulfur dioxide which was processed in a conventional manner to form sulfuric acid.

EXAMPLE II

A slurry was formed from 100 parts cement copper precipitate and 33 parts water. A separate slurry was formed from 100 parts copper sulfide concentrate, 15.5 parts $SiO_2$ and 3.5 parts limestone with 40 parts water.

61.4 parts of copper matte having 52 percent copper were charged into a Peirce-Smith converter at 2100° F. A lance projecting at 30° with respect to the horizontal was positioned to have the feed end directly above the molten bath. Oxygen-slurry feed was impinged on the surface of the molten bath with the initial slurry being composed of a 1:1 mixture of the above formed feed slurries. The temperature of the bath was monitored and the amount of copper precipitate was decreased or increased in direct relation to temperature fluctuation to maintain the temperature autogenously at approximately 2250° F.

Slag was skimmed from the converter charge and molten copper was poured from time to time. The materials were removed in amounts to maintain the molten bath at a workable volume.

While the invention has been described in connection with preferred embodiments; i.e., the production of copper, it is not intended to limit the invention to the particular forms set forth, but, on the contrary, it is intended to cover such alternatives, modifications, and equivalents, i.e., other nonferrous metals such as lead and nickel, as may be included within the spirit and scope of the invention as defined by the appended claims.

What is claimed is:

1. A process for the direct production of copper metal from a cupriferous slurry comprising forming a molten bath of cupriferous material at a temperature of about 2100° to 2400° F., at least one of said bath and said slurry comprising sufficient sulfidic materials to develop and maintain said bath temperature by oxidation of said sulfidic material, injecting an oxygen-containing gas and said cupriferous slurry into said molten bath, said injection being accomplished by use of a high-velocity stream of said gas and slurry directed at the surface of said bath at an angle of from about 20° to 40° from the horizontal, and separately withdrawing the resulting slag and metallic copper from the bath, the proportion of slurry and volume of oxygen injected being adjusted with respect to the available sulfidic material to permit operation at a temperature range of from about 2100° to 2400° F.

2. The process according to claim 1 wherein the oxygen gas is commercially pure oxygen.

3. The process according to claim 2 wherein the cupriferous slurry is prepared from copper sulfide concentrate or copper sulfide concentrate and cement copper precipitate.

4. The process according to claim 3 wherein the weight ratio of copper sulfide concentrate to cement copper precipitate in the slurry of copper sulfide concentrate and cement copper precipitate is from about 0.33 to about 3.33.

5. The process according to claim 4 wherein the ratio is about 1:1.

6. The process of claim 3 wherein the cupriferous slurry is a slurry of a copper sulfide concentrate which is injected at such rate as to maintain the bath temperature autogenously.

7. The process of claim 3 wherein the cupriferous slurry is a slurry of both copper sulfide concentrate and cement copper, and sufficient amount of matte is added to the molten bath to maintain the operating temperature throughout the time required to add a batch of predetermined amount of said slurry to the bath.

8. The process of claim 6 wherein the smelting temperature is maintained at from about 2200° F. to about 2300° F.

9. A process for the direct production of copper from a slurry of a copper sulfide comprising forming a molten cupriferous bath at a temperature of from about 2100° to 2400° F., continuously injecting said slurry together with oxygen gas into said bath by utilizing a high-velocity stream of said oxygen and slurry directed at the surface of said bath at an angle of approximately 30° from the horizontal, and continuously withdrawing molten metallic copper and slag from said bath, the sulfide content of slurry and the volume of oxygen injected being sufficient and being adjusted with respect to each other to permit autogenous operation at said temperature range of from about 2100° to 2400° F.

* * * * *